US005111107A

United States Patent [19]

Kume et al.

[11] Patent Number: 5,111,107

[45] Date of Patent: May 5, 1992

[54] GRID APPARATUS FOR A COLOR CATHODE RAY TUBE WHICH ELIMINATES VIBRATION OF THE GRIDS

[75] Inventors: Hisao Kume; Shuichi Kuwajima, both of Aichi; Takahide Sanma, Gifu, all of Japan

[73] Assignee: Sony Corporation, Tokyo, Japan

[21] Appl. No.: 509,751

[22] Filed: Apr. 17, 1990

[30] Foreign Application Priority Data

Apr. 18, 1989 [JP] Japan ..... 1-97853

[51] Int. Cl.[5] ..... H01J 29/80

[52] U.S. Cl. ..... 313/405; 313/404; 445/47

[58] Field of Search ..... 313/404, 405, 407, 402, 313/403; 445/47

[56] References Cited

U.S. PATENT DOCUMENTS

| | | | |
|---|---|---|---|
| 4,437,036 | 3/1984 | Ragland, Jr. | 313/402 |
| 4,495,437 | 1/1985 | Kume et al. | 313/403 |
| 4,756,702 | 7/1988 | Steiner | 445/30 |
| 4,904,218 | 2/1990 | Tong | 445/47 |

OTHER PUBLICATIONS

Japanese Abstract, vol. 12, No. 168 E-611 3015, May 20, 1988.

Japanese Abstract, vol. 12, No. 127 E-602 2974, Apr. 20, 1988.

Japanese Abstract, vol. 6, No. 123 E0117 0001, Jul. 8, 1982.

Japanese Abstract, vol. 10, No. 302 E-445 2358, Oct. 15, 1986.

PP. D-190-D-191, Commercial Metals and Alloys 1970.

*Primary Examiner*—Leo H. Boudreau
*Assistant Examiner*—Steven Klocinski

[57] ABSTRACT

A grid apparatus which has a multiplicity of ribbon-shaped grid elements stretched in tension and attached to a frame which comprises a pair of support bars and a pair of resilient support members. Metallic members which have a larger thermal expansion coefficient than the resilient support members are connected to the reverse surfaces of the resilient support members opposite the side to which the grid-elements are attached. In the grid apparatus during heat treatment, thermal creep of the grid elements is prevented so that the tension of the grid elements will remain high when the normal temperature state is resumed. A method of making such grid apparatus includes an additional heat treatment such as a blackening process after the reduction of the tension applied to the grid elements by the resilient support members and the support bars, hence preventing thermal creep of the grid elements to produce a high-reliability with high tension of the grid elements.

5 Claims, 4 Drawing Sheets

GRID APPARATUS FOR A COLOR CATHODE RAY TUBE WHICH ELIMINATES VIBRATION OF THE GRIDS

BACKGROUND OF THE INVENTION

1. Field of the Invention

The present invention relates to a grid apparatus for a color cathode ray tube which eliminates vibration of the grids and to a method of making such grid apparatus.

2. Description of Related Art

In conventional grid apparatus for a color cathode ray tube, aperture grills are known such as disclosed in Japanese patent publication Nos. 59 (1984)-18825 and 59 (1984)-18826. In such a grid apparatus, as shown in FIG. 4, a frame 5 comprises a pair of support bars 1, 2 disposed in parallel to each other with a predetermined space therebetween, and resilient support members 3, 4 which are substantially U-shaped are attached between the ends of the support bars 1, 2. A multiplicity of parallel spaced ribbon-shaped grid elements 6 are attached after being stretched with the required tension and at a predetermined pitch between the two support bars 1, 2 as shown. In making the grid apparatus 7, the grid elements 6 are welded to the frame 5 when they are stretched and deformed by pressure. Then they are welded after which the pressure which placed then in tension is released. Thus, the grid elements 6 are in a stretched condition and then they are heat-treated to blackened then in a temperature range of about 450°to 470° C.

However, thermal creep occurs in the grid apparatus 7 during the blackening process because the high temperature causes the stretched grid elements 6 to be expanded. As stated above, the grid elements 6 were welded to frame 5 before the blackening process. Also, spring-back of the frame 5 causes the tension to become lower in the grid elements 6 after the heat treatment than the tension was prior to the heat treatment because of the permanent deformation of the frame. Although the thermal creep occurs principally during the blackening process in the heat treatment, it also can occur at the time when frit sealing of a panel and a funnel in the heat treatment (at 440° C. or so) is done.

Therefore, when a television receiver with a color cathode ray tube is placed in operation after completion of the above processes, the grid elements 6 of the grid apparatus 7 will vibrate which is caused by sound in the television set which generates image noise. One of effective means for reducing such image noise is to maintain a higher tension of the grid elements 6. However, since the tension applied prior to the heat treatment is very close to the breaking strength limit of the grid elements 6, the tension cannot be further increased.

SUMMARY OF THE INVENTION

It is an object of the present invention to provide an improved grid apparatus which is capable of preventing thermal creep of the grid elements during the heat treatment which occurs in the prior art.

Another object of the present invention is to provide a method of making an improved grid apparatus with additional execution of a heat treatment such as a blackening process.

In a grid apparatus which has a multiplicity of ribbon-shaped grid elements set and which are stretched under tension on a frame which comprises a pair of mutually opposed support bars and a pair of resilient support members attached between the support bars, it is a feature of the present invention that metallic members which have a larger thermal expansion coefficient than the resilient support members are connected to the surfaces of the resilient support members which are opposite to the grid elements. In this structure, during heat treatment the grid elements of the grid apparatus will not be subject to thermal creep and high tension in the grid elements will be maintained when the normal temperature state is resumed.

Also, in a method of making the above grid apparatus it is a feature of the present invention to carry out heat treatment (principally a blackening process) under conditions where the tension applied to the grid elements by the resilient support members and the support bars is reduced, thereby eliminating thermal creep of the grid elements so as to allow the manufacture of highly reliable grid apparatus in which high tension of the grid elements is maintained.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

A grid apparatus and a method of making it according to the present invention will be described with reference to FIGS. 1 through 3.

Figure 1:
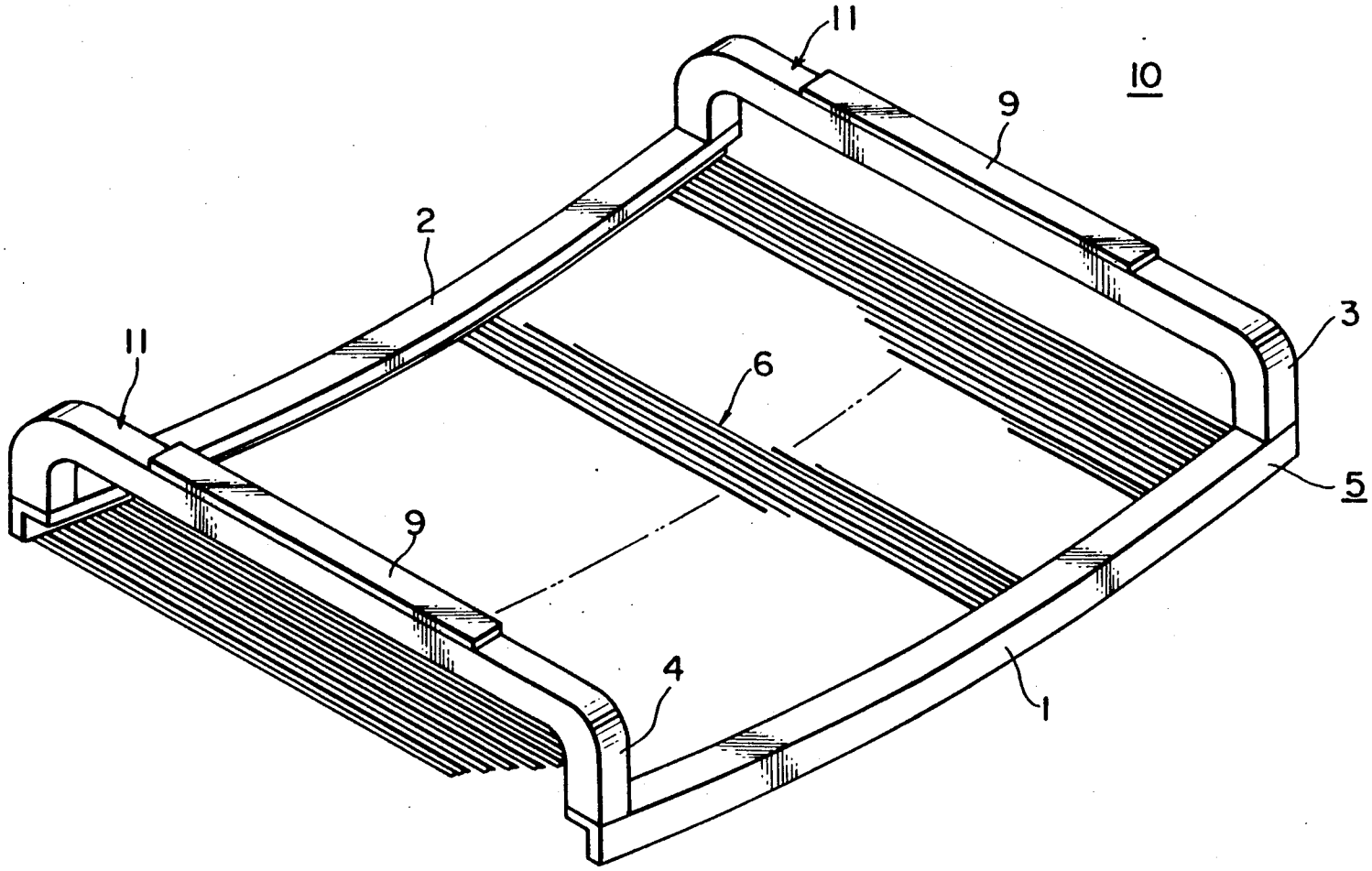
FIG. 1 is a perspective view of an exemplary grid apparatus embodying the present invention.
Figure 4:
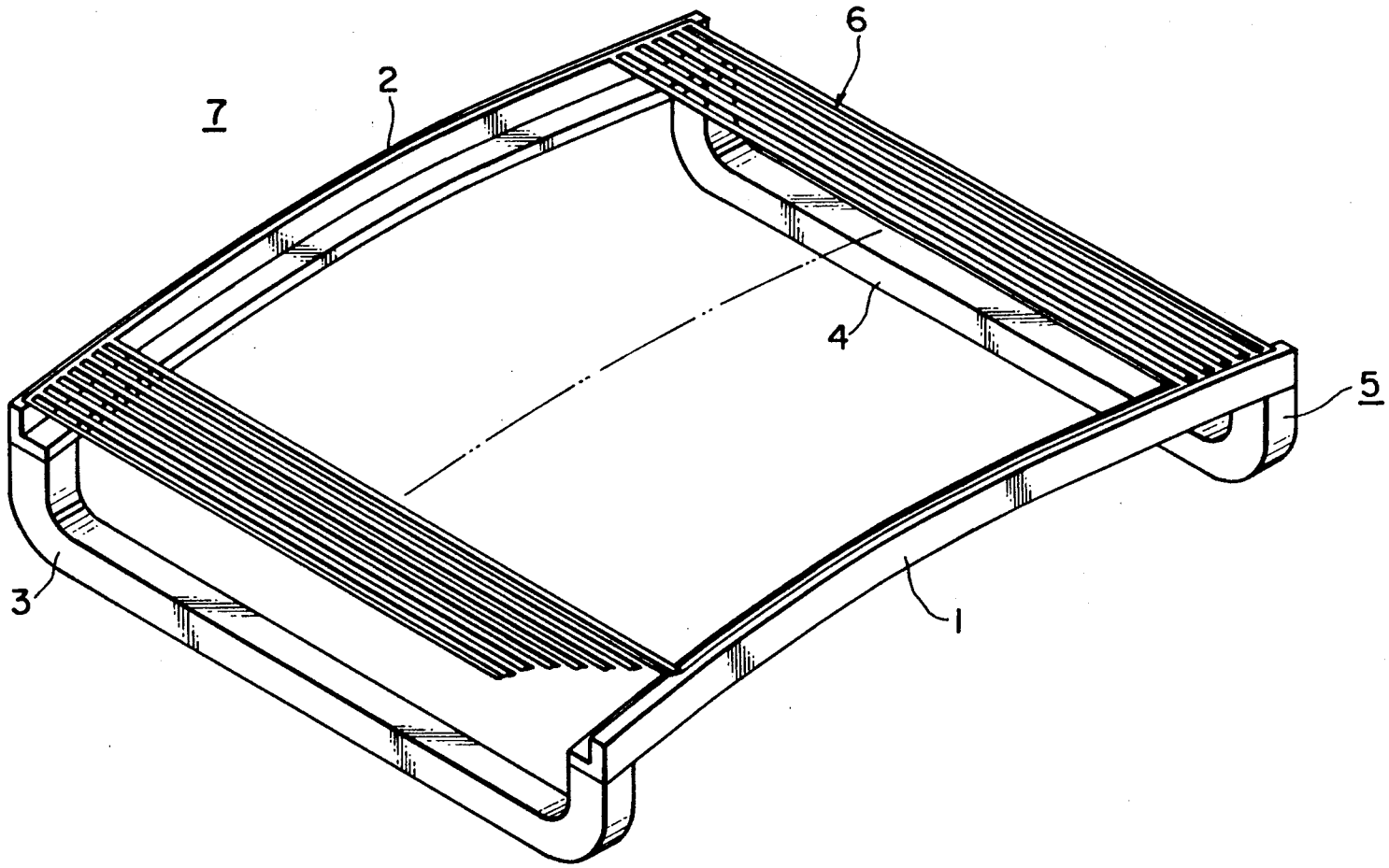
FIG. 4 Prior Art
FIG. 4 is a perspective view of a conventional grid apparatus.

FIG. 1 illustrates an exemplary grid apparatus embodying the present invention, wherein a frame 5 is substantially structurally the same as the conventional example mentioned in connection with FIG. 4. The frame 5 comprises a pair of support bars 1, 2 which are parallel to each other with a predetermined space between them. A pair of resilient U-shaped support members 3, 4 are attached between the ends of the two support bars 1, 2. A multiplicity of ribbon-shaped grid elements 6 are stretched with the required tension and then attached to one surface 5a of the frame 5 with a predetermined pitch between each grid element so as to bridge the space between the support bars 1, 2.

In this embodiment, metallic members 9 which have a larger thermal expansion coefficient than the resilient support members 3, 4 are attached by welding or other suitable means to the reverse surfaces 11 which are opposite to the side where the grid elements 6 are attached of the resilient support members 3, 4 which form the frame 5.

The metallic members 9 which are attached to the resilient support members 3, 4 in this embodiment are composed of stainless steel which has a thermal expansion coefficient of $20\times10^{-6}$ or so which is greater than the coefficient of $10\times10^{-6}$ to $12\times10^{-6}$ of the resilient support members 3, 4. However, it is to be understood that the thermal expansion coefficient of the metallic members 9 is not limited only to the above exemplary value, and a satisfactory results can be achieved if such coefficient is within a range of $15\times10^{-6}$ to $50\times10^{-6}$. Furthermore, as described above, the grid elements 6 are stretched with a desired tension on the frame 5 and, after the metallic members 9 are attached to the respective surfaces 11 of the two resilient support members 3, 4, a blackening process is executed at a high temperature 450°to 470° C. to produce a desired grid apparatus.

Figure 2:
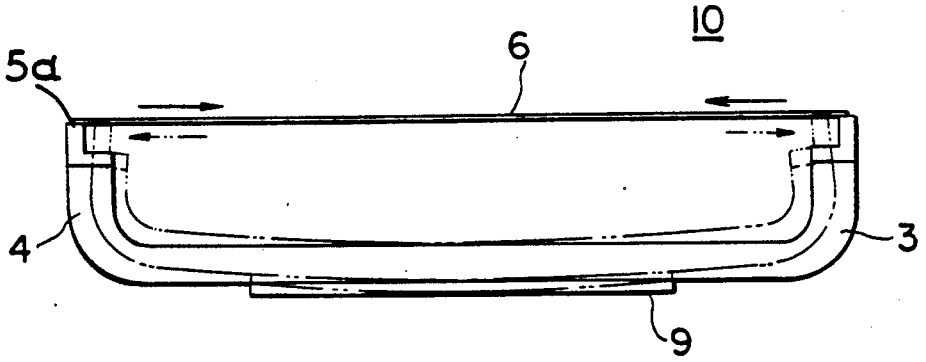
FIG. 2 is a side view illustrating the present invention.

In the grid apparatus 10 of such construction, the resilient support members 3, 4 are deformed so that they have a curvature, principally during the blackening process during heat treatment, and the curvature is in a direction so as to loosen the grid elements 6 and this is shown by a chain line in FIG. 2. This is due to the difference between the thermal expansion coefficients of the resilient support members 3, 4 and the metallic members 9, which causes the tension which is applied to the grid elements 6 to be reduced so as to consequently diminish the thermal creep of the grid elements 6.

Figure 3:
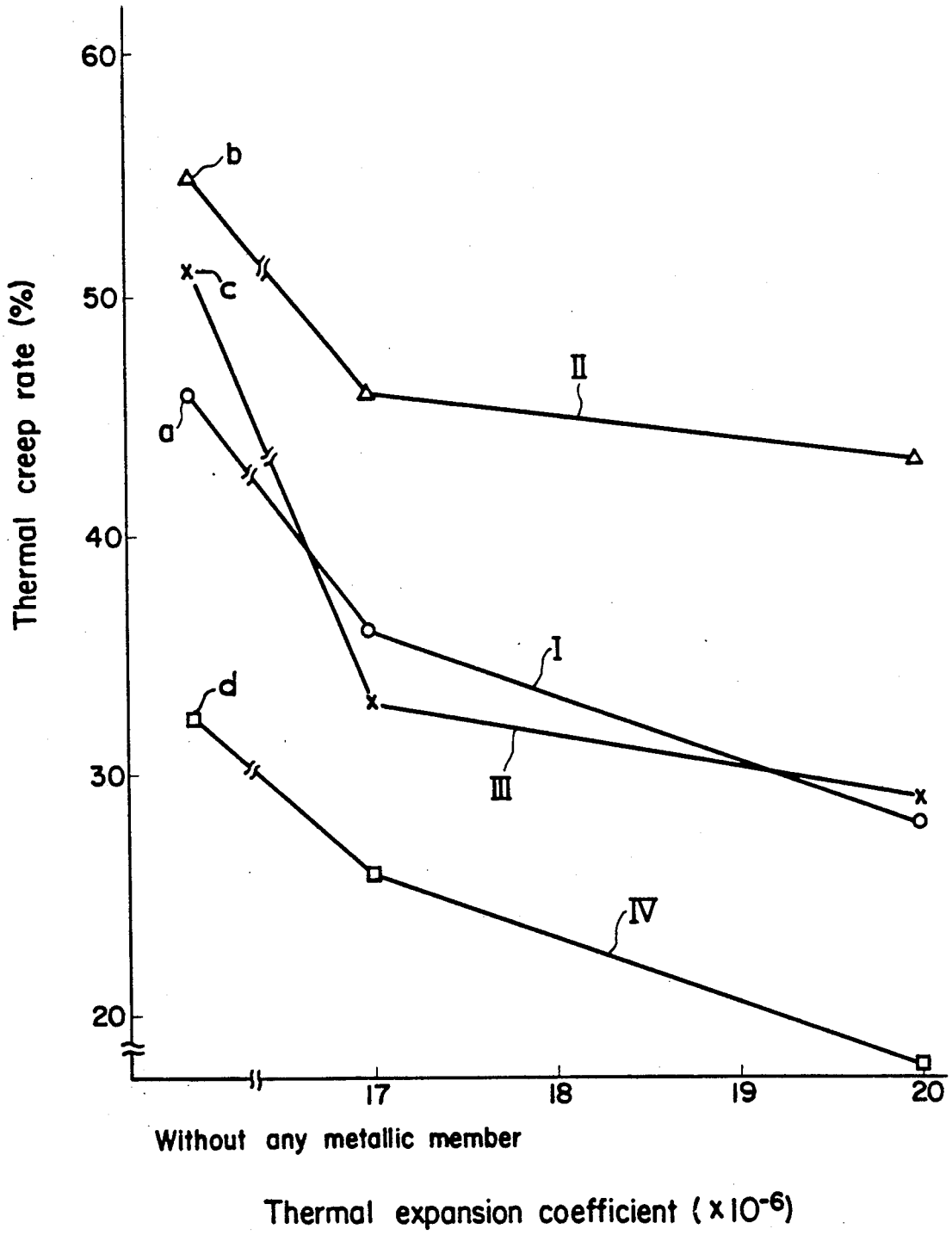
FIG. 3 is a graph which shows the relationship between thermal creep rate and thermal expansion rate of a metallic grid member.

FIG. 3 graphically shows the relationship between the thermal creep rate and the thermal expansion coefficient of the metallic member 9, wherein the thermal creep rate relative to the tension of the grid elements 6 which is reduced by the heat treatment is defined in percent (%). In this graphic representation, curves (I), (II), (III) and (IV) denote the values obtained in a 34-inch tube, a 29-inch tube, a 25-inch tube and a 14-inch tube, respectively. Points (a), (b), (c) and (d) show the creep rates of conventional grid apparatus without any metallic member 9 in the cathode ray tubes, respectively.

As is apparent from FIG. 3, in the grid apparatus 10 where the metallic members 9 which have a larger thermal expansion coefficient are connected to the reverse surfaces 11 of the resilient support members 3, 4 opposite to the grid-elements holding side, the thermal creep rate can be substantially reduced as compared with the rate in the conventional grid apparatus without any metallic member 9.

Consequently, when the grid apparatus 10 is placed in a normal temperature state again after the blackening process, high tension in the grid elements 6 will be maintained.

In the grid apparatus 10 of this embodiment, the phenomenon of thermal creep will be alleviated also during the frit sealing process for attaching a panel and a funnel during heat treatment.

Therefore, after completion of a television receiver with the cathode ray tube incorporated therein, the grid elements 6 will not be vibrated by any ordinary television sound level and consequently a high-quality video output can be ensured with minimized image noise.

In the embodiment described, the metallic members 9 which have a larger thermal expansion coefficient than that of the resilient support members 3, 4 of the frame 5 are securely attached, and when a blackening process is carried out under conditions where the tension which is applied to the grid elements 6 will be reduced by utilizing the difference between the thermal expansion coefficients of the resilient support members 3, 4 and the metallic members 9. However, reduction of the thermal creep rate can also be attained by another method which applies pressure to the pair of support bars 1, 2 of the frame 5 by mechanical means without joining the metallic members 9 and a blackening process is executed under conditions so that the tension of the grid elements 6 will be substantially reduced. Such pressure can be applied by a jig or vice which prevents the frame from expanding during heating so that it will not be permanently deformed during the heating.

Thus, due to execution of the blackening process under conditions where the tension applied to the grid elements 6 is reduced by utilizing the difference between the thermal expansion coefficients of the resilient support members 3, 4 and the metallic members 9 or by mechanically bonding the frame 5, the thermal creep of the grid elements 6 can be suppressed to assure the manufacture of a satisfactory grid apparatus 10 in which high tension of the grid elements 6 is maintained.

According to the grid apparatus of the present invention, metallic members having a greater thermal expansion coefficient than a pair of resilient support members of a frame are attached to the reverse surfaces of the resilient support members on the side opposite to where the grid elements are attached, so that the thermal creep of the grid elements can be reduced during a blackening process and a subsequent frit sealing process for a panel and a funnel during heat treatment, thereby maintaining the tension of the grid elements sufficiently high after the heat treatment. Consequently, when the present invention is applied to a television receiver, the grid elements will not be vibrated by ordinary television sound which will ensure a high-quality video output without image noise.

Furthermore, in the method of the present invention for making such grid apparatus heat treatment which includes a blackening process is carried out after the reduction of the tension applied to grid elements accomplished by a pair of resilient support members and a pair of support bars, whereby the thermal creep of the grid elements is suppressed during heat treatment. As a result, it becomes possible to manufacture a high-reliability grid apparatus where high tension of the grid elements is maintained.

Although the invention has been described with respect to preferred embodiments, it is not to be so limited as changes and modifications can be made which are within the full intended scope of the invention as defined by the appended claims.

WE CLAIM AS OUR INVENTION:

1. A grid apparatus for a color cathode ray tube comprising:

a frame comprising a pair of mutually opposed support bars and a pair of resilient support members attached between said support bars;

a plurality of parallel ribbon-shaped grid elements stretched under tension and attached to said frame; and metallic members which have a larger thermal expansion coefficient than said resilient support members connected to reverse surfaces of said resilient support members on the sides which are opposite to the grid elements.

2. A grid apparatus according to claim 1, wherein the thermal expansion coefficient of said resilient support members is in a range from $10\times10^{-6}$ to $12\times10^{-6}$.

3. A grid apparatus according to claim 1, wherein the thermal expansion coefficient of said metallic members is in a range from $15\times10^{-6}$ to $50\times10^{-6}$.

4. A method of making a grid apparatus for a color cathode ray tube in which a plurality of ribbon-shaped grid elements are stretched under tension and attached to a frame consisting of a pair of mutually opposed support bars and a pair of resilient support members which are attached between said support bars, said method including:

a step of carrying out heat treatment under conditions where the tension which is applied to said grid elements by said resilient support members and said support bars is reduced by using metallic members connected to said support bars and wherein said metallic members are attached to said support bars on sides to reduce said tension and said metallic members have a larger coefficient of thermal expansion than said support bars.

5. A method according to claim 4, wherein said heat treatment includes a blackening process executed in a temperature range of 450°to 470° C.

* * * * *